US005899091A

United States Patent [19]

Fraser, Jr. et al.

[11] Patent Number: 5,899,091

[45] Date of Patent: May 4, 1999

[54] REFRIGERATION SYSTEM WITH INTEGRATED ECONOMIZER/OIL COOLER

[75] Inventors: Howard H. Fraser, Jr., Lafayette; Russell G. Lewis, Manlius; Michael F. Taras, Fayetteville, all of N.Y.

[73] Assignee: Carrier Corporation, Syracuse, N.Y.

[21] Appl. No.: 08/991,588

[22] Filed: Dec. 15, 1997

[51] Int. Cl.[6] ..... F25B 43/02; F25B 41/00

[52] U.S. Cl. ..... 62/473; 62/513

[58] Field of Search ..... 62/473, 513; 165/140, 165/141

[56] References Cited

U.S. PATENT DOCUMENTS

| | | | |
|---|---|---|---|
| 3,621,673 | 11/1971 | Foust . | |
| 3,941,356 | 3/1976 | Mason | 165/141 |
| 4,208,887 | 6/1980 | Morse et al. . | |
| 4,217,765 | 8/1980 | Ecker . | |
| 4,488,413 | 12/1984 | Bottum . | |
| 4,938,036 | 7/1990 | Hougkins et al. . | |

FOREIGN PATENT DOCUMENTS

| | | | |
|---|---|---|---|
| 406123500 | 5/1994 | Japan | 62/473 |

*Primary Examiner*—William Wayner

*Attorney, Agent, or Firm*—Bryan D. Rockwell

[57] ABSTRACT

A refrigeration system for cooling air s disclosed. The system includes a substantially liquid refrigerant and an evaporator for transferring heat from the air to the substantially liquid refrigerant. The substantially liquid refrigerant becomes a low temperature, low pressure first superheated gas refrigerant. A compressor compresses the first superheated gas refrigerant into a high pressure, high temperature second further superheated gas refrigerant. A lubricant circuit supplies lubricant to the compressor, wherein a portion of the lubricant is mixed with the further superheated gas refrigerant. A condenser rejects heat from the second superheated gas refrigerant and forms a high pressure, low temperature sub-cooled liquid refrigerant. The condenser has an output stream. A metering device transforms the sub-cooled liquid refrigerant into the substantially liquid refrigerant for the evaporator. An economizer circuit provides an intermediate temperature and pressure economizer refrigerant flow to the compressor. The economizer refrigerant flow originates from the output stream of the condenser. The economizer circuit includes an economizer heat exchanger. The economizer heat exchanger includes paths for receiving and cooling the lubricant before returning to the compressor and the sub-cooled liquid refrigerant on route to the metering device, wherein the economizer refrigerant flow is a cooling medium in the heat exchanger.

10 Claims, 1 Drawing Sheet

REFRIGERATION SYSTEM WITH INTEGRATED ECONOMIZER/OIL COOLER

TECHNICAL FIELD

This invention is directed to refrigeration systems, and more particularly, to a refrigeration system having an improved oil cooling circuit for lowering the discharge temperature of the compressor thus increasing compressor reliability and for increasing the viscosity of the oil to enhance system performance.

BACKGROUND ART

Conventional air conditioning systems cool air in confined spaces by using four main components, including a compressor, condenser, metering device, and an evaporator. These components also provide the basis for most refrigeration cycles. However, as systems become more technologically advanced, additional components are added. Generally, the compressor compresses refrigerant gas to a high pressure, high temperature, superheated gaseous state for use by the condenser. The condenser, in cooling the superheated gas, produces a sub-cooled liquid refrigerant with a high pressure and lower temperature. The metering device, such as an expansion valve, produces a low temperature, low pressure saturated liquid-vapor mixture from the sub-cooled liquid. Finally, the evaporator converts the saturated liquid-vapor mixture, to a low temperature, low pressure superheated gas during air cooling for use by the compressor. The overall performance and efficiency of refrigeration cycles are directly dependent upon the heat transfer provided by the condenser, evaporator, and compressor oil cooler, The overall performance is further dependent upon the performance and lubrication of the compressor.

During operation, most compressors use lubricants which reduce wear and/or seal gaps in the compressor to prevent internal refrigerant leakage. By maintaining the compressor lubricants at relatively low temperature, compressor efficiency and reliability are increased, providing improved lubricant sealing properties due to increased oil viscosity, improved compressor cooling, and decreased frictional wear. For example, screw type compressors utilize counter-rotating rotors to compress refrigerant gas. Such compressors rely on lubricants to reduce friction between mating parts and seal gaps between the rotors and crankcase thereof. Typically, the refrigerant includes some amount of the acquired lubricants before entering the compressor, but some rotating compressor technology injects the oil into the compression process separately.

More particularly, refrigerant enters a compressor in vapor form and is compressed, thereby increasing in pressure and temperature. The compressor releases the refrigerant and lubricant mixture and the mixture subsequently travels throughout the refrigeration system via a series of closed conduits. In some refrigeration cycles, the refrigerant and lubricant mixture exits the compressor and enters an oil separator. The oil is separated from the refrigerant and the refrigerant is routed to a condenser where the heat removal operation via a cooling medium such as outdoor air, occurs on the refrigerant. With heat removed, the refrigerant exits the condenser at high pressure and lower temperature. In a liquid form, the compressor lubricant flows through an oil cooler, such as a heat exchange apparatus, similar to the condenser, wherein air is the cooling medium. The cooled oil flows back to the compressor, functioning to lower the refrigerant discharge temperature and increase the efficiency of the compressor. The refrigerant flows from the condenser to the metering device, such as an expansion valve, wherein temperature and pressure of the refrigerant are reduced for subsequent use by the evaporator and results in cooling of the air of the desired space. Between the condenser and the evaporator, refrigeration cycles such as this may also include an economizer circuit for use in further cooling of the main refrigerant stream. In such cases, an economizer heat exchanger is provided through which the main refrigerant stream passes for cooling. A secondary refrigerant flow off-shooting from the main line exiting the condenser is passed through an auxiliary metering device for achieving intermediate pressure and temperature refrigerant. This refrigerant is used in further sub-cooling of the main refrigerant flow prior to its passage through the metering device. With the main refrigerant stream cooled in this manner, it can be used in another heat exchange mechanism for further lowering its temperature by the expense of the refrigerant traveling from the evaporator to the suction port of the compressor.

As indicated above, typically oil is cooled by using a separate oil cooler. However, the prior art does include refrigeration systems which combine the oil cooling with other cooling steps in a simultaneous process. For example, U.S. Pat. No. 5,570,583 discloses the integration of an oil cooler with a refrigerant condenser. The system uses the refrigerant to cool the compressor lubricant. However, a parasitic loss of compressor capacity occurs because the main refrigerant stream is used to directly cool the oil and in the process, evaporates a certain amount of refrigerant, reducing available sub-cooling. Accordingly, some amount of the compressor power is increased and the system capacity is decreased. The use of separate oil coolers, in the form of heat exchangers as described above, substantially adds to the part count of refrigeration systems, as well as requiring the use of additional refrigeration circuits or additional external energy source to accomplish cooling. At the same time, by combining two heat transfer processes in one heat exchanger they can be arranged in the most efficient optimal manner through heat flux redistribution, which is not possible otherwise.

There exists a need, therefore, for an improved refrigeration cycle including a more efficient design for cooling the compressor lubricant.

DISCLOSURE OF INVENTION

The primary object of this invention is to provide an improved refrigeration system, having a refrigeration cycle with more efficient means for cooling the compressor lubricant.

Another object of this invention is to provide an improved refrigeration system having an economizer circuit, which economizer circuit includes a heat exchanger for more efficiently cooling the main refrigerant stream as well as the compressor lubricant.

Still another object of this invention is to provide an improved heat exchanger for use in a refrigeration system, which heat exchanger includes an economizer circuit for simultaneously cooling both the compressor lubricant and the main refrigerant flow.

The foregoing objects and following advantages are achieved by the refrigeration system for cooling air of the present invention. The system includes a substantially liquid refrigerant and an evaporator for transferring heat from the air to the substantially liquid refrigerant. The substantially liquid refrigerant becomes a low temperature, low pressure first superheated gas refrigerant. A compressor compresses the first superheated gas refrigerant into a high pressure, high temperature second further superheated gas refrigerant. A lubricant circuit supplies lubricant to the compressor, wherein a portion of the lubricant is mixed with the second superheated gas refrigerant. A condenser rejects heat from the second superheated gas refrigerant to form a high pressure, lower temperature sub-cooled liquid refrigerant. The condenser has an output stream. A metering device transforms the sub-cooled liquid refrigerant from the condenser into the substantially liquid refrigerant for the evaporator. An economizer circuit provides an intermediate temperature and pressure economizer refrigerant flow to the compressor. The economizer refrigerant flow originates from the output stream of the condenser. The economizer circuit includes an economizer heat exchanger. The economizer heat exchanger includes paths for receiving and cooling the lubricant before returning to the compressor and the sub-cooled liquid refrigerant on route to the metering device, wherein the economizer refrigerant flow is a cooling medium in the heat exchanger.

BRIEF DESCRIPTION OF THE DRAWING

The FIGURE is a schematic representation of the refrigeration system in accordance with the principles of the present invention, which system uses an economizer circuit heat exchanger for cooling both the main refrigerant stream and the compressor lubricant.

BEST MODE FOR CARRYING OUT THE INVENTION

Figure 1:
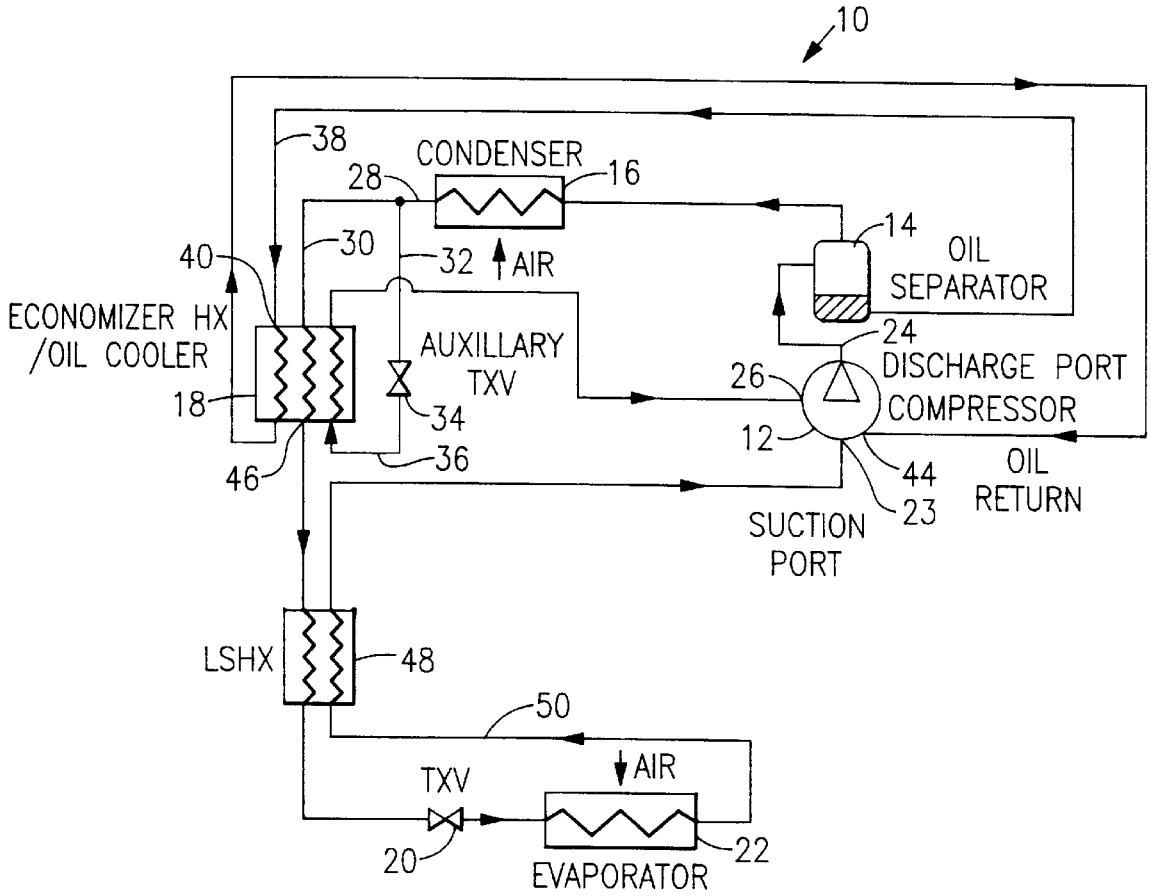

Referring to the FIGURE, shown is the refrigeration system and cycle of the present invention, designated generally as 10. System 10 generally includes a compressor 12, an oil separator 14, a condenser 16, an integrated economizer/oil cooler heat exchanger 18, a metering device 20 and an evaporator 22. The main four elements of a refrigeration system, including the compressor, the condenser, metering device and evaporator are arranged, from a general standpoint, in a manner known in the art for all refrigeration systems.

Compressor 12, which may be in the form of a screw, rotary, reciprocal or scroll compressor, includes a suction port 23 for receiving a low temperature, low pressure superheated gas refrigerant from evaporator 22. This superheated gas refrigerant is compressed in compressor 12 which outputs the high temperature, high pressure superheated gas to oil separator 14 from outlet port 24. Compressor 12 also includes an intermediate port 26 receiving refrigerant sent through an economizer circuit, originating at the output of condenser 16, which is at an intermediate temperature and pressure. The refrigerant exists compressor 12 into oil separator 14, wherein compressor lubricant typically is separated from the refrigerant and then returned to the compressor, as discussed in more detail below. The refrigerant then enters condenser 16, wherein the refrigerant is de-superheated, condensed, and sub-cooled through a heat exchange process with ambient air to a lower temperature, high pressure, sub-cooled liquid. The liquid refrigerant exits condenser 16 at outlet 28, where it is split into two streams. The two streams include the main refrigerant stream 30 and the economizer refrigerant stream 32. The economizer refrigerant stream 32 flows through an auxiliary thermal expansion valve 34 and exits valve 34 as economizer stream 36 as an intermediate temperature, intermediate pressure saturated liquid-vapor mixture. This saturated liquid-vapor mixture exiting valve 34 is used as the coolant in heat exchanger 18. The main refrigerant stream 30 flows in the opposite direction of the economizer refrigerant stream 36 to provide a counter-flow arrangement. In addition to the main refrigerant stream and the economizer refrigerant stream flowing through heat exchanger 18, oil return line 38 flows into heat exchanger 18 at inlet 40. Since the oil had been processed through compressor 14, the oil is at a higher temperature and pressure than the refrigerant of the economizer stream, which simultaneously flows through heat exchanger 18. Therefore, as the oil flows through heat exchanger 28 in a counter-flow direction to the economizer refrigerant stream 36, the temperature of the oil is substantially reduced. The oil flows through line 42 back to an oil return port 44 of compressor 12. At the lower temperature, the oil functions to decrease the discharge pressure, thereby increasing the reliability and efficiency of the compressor. The main refrigerant stream 30 exits heat exchanger 18 at outlet 46 on route to evaporator 22. Heat exchanger 18 may be in the form as known in the art and preferably is a brazed plate or tube-in-tube heat exchanger design.

The refrigerant from outlet 46 flows from heat exchanger 18 into a liquid line-suction line heat exchanger 48 (LSHX), which is used to further pre-cool refrigerant flowing into evaporator 22 before its heat exchange with the air being cooled by system 10. Refrigerant flows from LSHX 48 into metering device 20, which is preferably in the form of a thermal or electronic expansion valve, and exits the expansion valve as a low temperature and low pressure saturated liquid-vapor mixture. The air to be cooled by system 10 flows through evaporator 22 in a heat exchange relationship with the liquid-vapor refrigerant mixture entering evaporator 22 from the metering device 20. Refrigerant in evaporator 22 changes from a saturated liquid-vapor mixture to a superheated gas due to its low boiling temperature and the temperature differential between the lower temperature refrigerant and the air being cooled. The superheated gas refrigerant exits evaporator 22 in line 50 and flows through LSHX 48 for precooling counterflowing refrigerant form heat exchanger 18, prior to its entrance to compressor 12 through suction port 23.

Through this arrangement, the oil used to lubricate compressor 12 is cooled in a unique manner via economizer heat exchanger 18 by a counter-flow arrangement with the coolant in the economizer stream circuit. That is, through cooling, the oil viscosity is increased, becoming a more efficient friction reducing medium as well as allowing for cooler operation of the mechanical components of the compressor. For existing systems which use a separate oil cooler, an economizer oil cooling circuit can be added and the economizer refrigerant will pass through the economizer heat exchanger for achieving the same results as discussed above.

In operation, air to be cooled is forced to pass over or through evaporator 22 for the exchange of heat with refrigerant flowing through the evaporator. The refrigerant leaves the evaporator, having absorbed the heat of the air, as a low temperature, low pressure superheated gas. The refrigerant flows through LSHX 48 for superheating prior to entering compressor 12. The refrigerant in the superheated gaseous state enters the compressor while the compressor is lubricated via cooled oil entering port 44. The refrigerant combines with refrigerant from intermediate port 26 and exits compressor 12 at outlet 24 and enters oil separator 14. Oil is separated from the refrigerant and returned to compressor 12 after being cooled in heat exchanger 18. Refrigerant flows from oil separator 14 into condenser 16 and leaves condenser 16 in a lower temperature, high pressure sub-cooled liquid state. The sub-cooled liquid is split into the main refrigerant stream 30 and the economizer stream 32. The economizer refrigerant stream 32 flows into a thermal expansion valve 34 and leaves valve 34 in a low temperature and low pressure saturated liquid-vapor mixture state. The refrigerant then flows as stream 36 in this state into heat exchanger 18, acting as the cooling medium for that heat exchanger. After performing cooling in heat exchanger 18, the refrigerant is returned to compressor 12 through intermediate port 26. The main refrigerant stream 30 passes through heat exchanger 18 and is cooled by the refrigerant in economizer stream 36 flowing in a counter flow arrangement. The main refrigerant stream 30 exits heat exchanger 18 in a cooler state for subsequent cooling in LSHX 48. Oil from oil separator 14 enters heat exchanger 18, similar to the main refrigerant stream 30, and is cooled by the counter-flowing refrigerant of the economizer stream 36. Oil returns to compressor 12 through port 44 at a lower temperature and higher viscosity for cooling the compressor, achieving improved sealing capabilities and reducing friction among the mechanical components of the compressor. In finishing the refrigeration cycle, the refrigerant flows from LSHX 48, through metering device 20, exiting therefrom at a low temperature, low pressure saturated, substantially liquid, liquid-vapor mixture. This mixture enters evaporator 22 whereby, as indicated in the beginning, it is boiled and then superheated through a heat exchange arrangement.

The primary advantage of this invention is that an improved refrigeration system is provided, having a refrigeration cycle with more efficient means for cooling the compressor lubricant. Another advantage of this invention is that an improved refrigeration system is provided having an economizer circuit, which includes a heat exchanger for cooling the main refrigerant stream as well as the compressor lubricant. Another advantage of this invention is that an improved heat exchanger for use in a refrigeration system is provided which comprises and economizer circuit for cooling both the compressor lubricant and the main refrigerant flow.

Although the invention has been shown and described with respect to the best mode embodiment thereof, it should be understood by those skilled in the art that the foregoing and various other changes, omissions, and additions in the form and detail thereof may be made without departing from the spirit and scope of the invention.

What is claimed is:

1. A refrigeration system for cooling air, comprising:

a substantially liquid refrigerant;

an evaporator for transferring heat from the air to said first substantially liquid refrigerant, whereby said first substantially liquid refrigerant becomes a low temperature, low pressure first superheated gas refrigerant;

a compressor for compressing said first superheated gas refrigerant into a high pressure, high temperature second further superheated gas refrigerant;

a lubricant circuit for supplying lubricant to said compressor;

a condenser for rejecting heat from second further superheated gas refrigerant and forming a high pressure, lower temperature sub-cooled liquid refrigerant, said condenser having an output stream;

a metering device for transforming said sub-cooled liquid refrigerant into said substantially liquid refrigerant for said evaporator;

an economizer circuit for providing an intermediate temperature and pressure economizer refrigerant flow to said compressor, originating from said output stream of said condenser, said economizer circuit including an economizer heat exchanger including paths for receiving and cooling said lubricant before returning to said compressor and said sub-cooled liquid refrigerant on route to said metering device, wherein said economizer refrigerant flow is a cooling medium in said heat exchanger.

2. The system according to claim 1, further including another heat exchanger positioned between said first heat exchanger and said evaporator, wherein said sub-cooled liquid refrigerant and said first superheated gas refrigerant flow through said another heat exchanger in a counterflow direction with said sub-cooled liquid refrigerant acting as a coolant.

3. The system according to claim 1, wherein said economizer flow is arranged in a counter flow pattern with said lubricant and said sub-cooled liquid refrigerant.

4. The system according to claim 1, wherein said economizer heat exchanger has a brazed plate heat exchanger design.

5. The system according to claim 1, wherein said economizer heat exchanger has a tube-in-tube heat exchanger design.

6. The system according to claim 1, wherein a portion of said lubricant is mixed with said second superheated gas refrigerant, further including a separator for separating said lubricant from said second superheated gas refrigerant.

7. The system according to claim 1, wherein said metering device is a thermal expansion valve.

8. The system according to claim 1, wherein said economizer circuit further includes an auxiliary metering device in the path of said economizer refrigerant flow before said economizer heat exchanger.

9. The system according to claim 1, wherein said substantially liquid refrigerant is a liquid-vapor mixture.

10. The system according to claim 1, wherein said metering device is an electronic expansion valve.

* * * * *